United States Patent [19]

Gsching, deceased

[11] 4,033,239

[45] July 5, 1977

[54] RADIAL PISTON MACHINE

[75] Inventor: Wilhelm Gsching, deceased, late of Heidenheim, Germany, by Irmgard Gsching, heiress

[73] Assignee: Sulzer Brothers Limited, Winterthur, Switzerland

[22] Filed: Apr. 10, 1975

[21] Appl. No.: 566,810

[30] Foreign Application Priority Data

Apr. 13, 1974 Germany ..... 2418164

[52] U.S. Cl. ..... 92/58; 91/491; 92/148

[51] Int. Cl.² ..... F01B 13/06

[58] Field of Search ..... 92/58, 12.1, 148, 72; 91/488, 491, 497

[56] References Cited

UNITED STATES PATENTS

| | | | |
|---|---|---|---|
| 1,778,238 | 10/1930 | Wilsey | 91/488 |
| 3,255,706 | 6/1966 | Eickmann | 92/58 X |
| 3,304,883 | 2/1967 | Eickmann | 92/58 X |
| 3,724,334 | 4/1973 | Denker | 92/58 X |
| 3,730,054 | 5/1973 | Dickinson | 91/491 |
| 3,777,624 | 12/1973 | Dixon | 91/488 |
| 3,785,250 | 1/1974 | Steiger | 92/72 |
| 3,942,414 | 3/1976 | Eddy | 91/491 |

*Primary Examiner*—Martin P. Schwadron
*Assistant Examiner*—Abraham Hershkovitz
*Attorney, Agent, or Firm*—Kenyon & Kenyon, Reilly, Carr & Chapin

[57] ABSTRACT

The moving parts of the machine are mounted as a unit on the control journal. These parts include the cylinder block, pistons, piston guide ring, lateral support disks and drive shaft. The unit may be removed as such without having to remove the control journal from the housing. The diameters of the bearing surfaces for the lateral support disks and cylinder block are of successively reduced diameter from each other to facilitate the unit construction.

2 Claims, 2 Drawing Figures

RADIAL PISTON MACHINE

Figure 1:
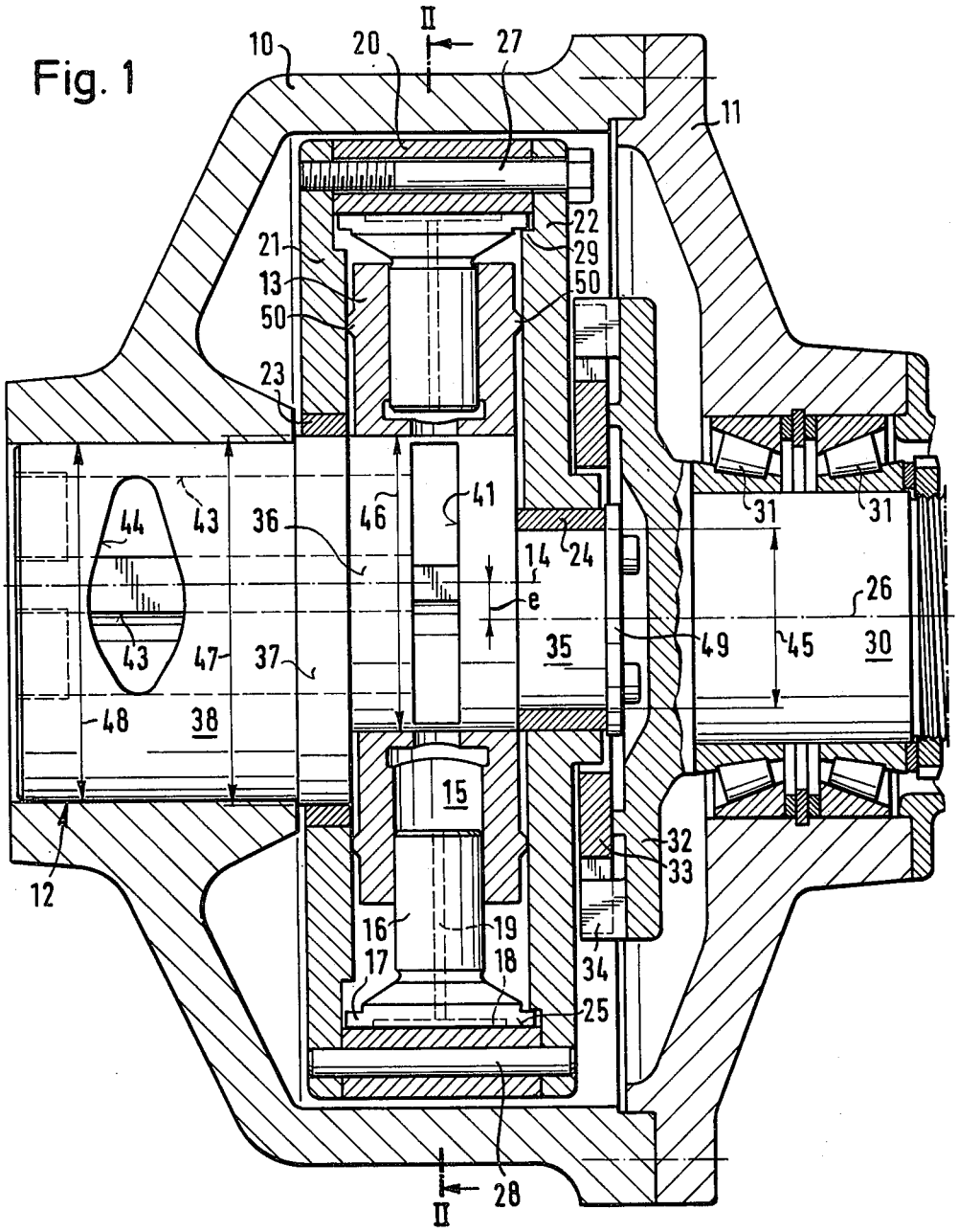

This invention relates to a radial piston machine.

Various types of radial piston machines have been known for use as pumps or as motors in order to hydrostatically convert mechanical energy into pressure energy or vice versa. Such machines generally employ an oil for the operating medium. In some instances, these machines have been constructed with a control journal fixed in a housing, a rotatable cylinder block in which radially movable pistons are mounted, a guide ring for the pistons and lateral support disks for the pistons. In machines of this type, the cylindrical bearing surface of the inner support disk has been of the same diameter as the cylindrical bearing surface for the outer support disk, i.e. the two support disks and their bearings are made quite symmetrical. This construction, however, has the great drawback that, in the assembly of the radial machine, the inner support disk must be set on the control journal before the insertion of the control journal into the machine housing and that then the remaining parts, particularly the pistons-guide ring and the outer support disk, must be introduced into the machine housing with the inner support disk. A further drawback resides in that for any necessary repairs, the mount for the inner support disk of the control journal has to be removed from the machine housing and then reinstalled. This means that one has to do without an easily detached connection between the control journal and the housing, i.e. the part of the control journal to be installed in the housing and the associated bore would have to be made tapered so that the control journal can be fastened in the housing by screws. Such a form of construction is very expensive.

Accordingly, it is an object of this invention to provide a radial piston machine which can be assembled in a simple manner.

It is another object of the invention to permit the moving parts of a radial piston machine to be assembled as a unit.

It is another object of the invention to allow a control journal of a radial piston machine to remain in the housing of the machine when removing the piston support disks for repairs or maintenance.

Briefly, the invention is directed to a radial piston machine having a housing, a control journal having a cylindrical part of predetermined diameter fixedly mounted in the housing and a cylinder block rotatably mounted about an axis of rotation on a first cylindrical bearing surface of the control journal. The machine also has a plurality of pistons circumferentially disposed in the cylinder block for radial displacement relative to the control journal. Each of these pistons has a bearing shoe which bears on a plane surface of a piston-piloting ring mounted around the pistons and cylinder block. The ring has an axis of rotation of offset from the axis of rotation of the cylinder block by a preset eccentricity. A pair of rotatable support disks are also secured to the piston-piloting ring on opposite sides of the cylinder block. An inner one of these disks is rotatably mounted on a cylindrical bearing surface of the control journal which is of a diameter greater than the bearing surface for the cylinder block by an amount at least twice the eccentricity of the ring to the cylinder block.

By mounting the pistons guide ring over the lateral support disks on the control journal, assurance is made that the radial force acting on the piston-guide ring and resulting from the piston forces, is transmitted to the control journal. Thus, a direct and complete balancing of the hydrostatic forces acting on the control journal can be obtained. Contrary to other known constructions, the control journal transmits no radial forces to the housing but only the reaction torque.

Further, the entire rotatable group consisting of the cylinder block, the pistons, the piston-guide ring, the lateral support disks and the drive shaft can be assembled as a unit outside the machine housing. After installation of the control journal in the machine housing, this unit can be introduced as a whole into the machine housing. Equally simple is the disassembly of the machine for any necessary check or repairs of the bearing surfaces of the support disks because the control journal may remain in the machine housing. Thus, since the connection between the control journal and the housing does not need to be undone, that connection may be in the form of a press fit or shrunk-in connection, thus reducing manufacturing costs.

The outer support disk is rotatably mounted about a third cylindrical bearing surface of the control journal which is of a diameter smaller than the diameter of the bearing surface for the cylinder block and this by an amount at least twice the eccentricity of the piston-guide ring to the cylinder block. In this way the bore in the housing for receiving the control journal may be concentric of the housing and, thus, also concentric of the bore in the housing which serves for the passage, or on occasion as a bearing, for the drive shaft. This also simplifies the manufacture of the housing. The diameter of the part of the control journal directly inserted into the housing, and hereafter termed "seat diameter" must thus be about equal to the nearby diameter of the bearing of the inner support disk. That is, the "seat diameter" must be made relatively large so that the axial holes through the control journal for conducting an operating medium, may be made rectilinear, and preferably parallel with the axis. If the seat diameter is made slightly less than the nearby bearing diameter, this facilitates the pressing-in or shrinking-in of the control journal into the housing, because this part of the control journal then forms a bearing surface of the housing with the aforesaid bearing diameter.

Figure 2:
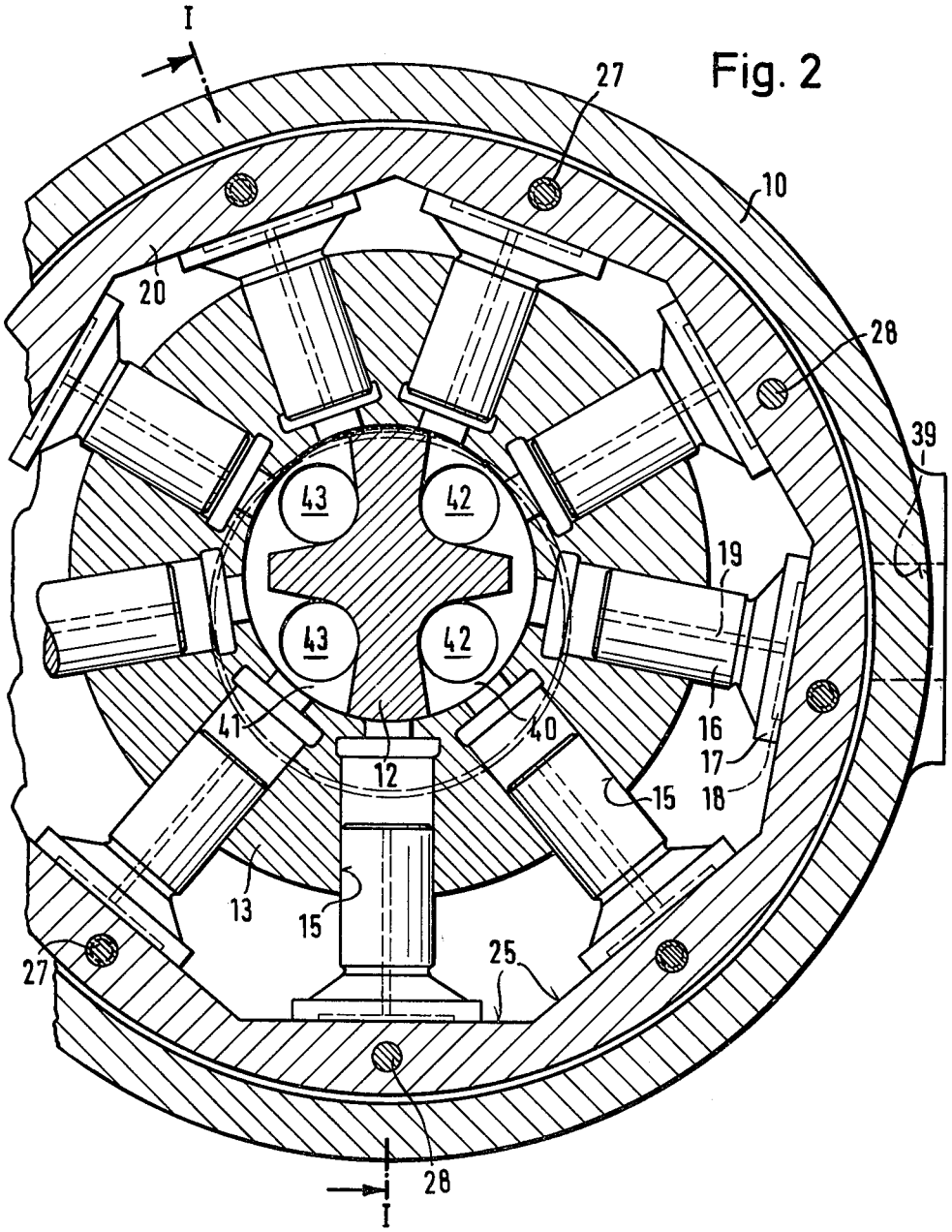

These and other objects and advantages of the invention will become more apparent from the following detailed description and appended claims taken in conjunction with the accompanying drawings in which:

FIG. 1 illustrates a longitudinal sectional view through a radial piston machine according to the invention; and FIG. 2 illustrates a view taken on line II—II of FIG. 1.

Referring to FIG. 1, the radial piston machine includes a housing 10 with a housing cover 11 into which a control journal 12 is mounted for example by a press-fit. A cylinder block 13 is rotatably mounted on the control journal 12 within the housing 10 about an axis of rotation 14. The cylinder block 13 has a plurality of circumferentially disposed cylinders 15 in which pistons 16 are slidably mounted for relative radial movement relative to the axis of rotation 14. Each piston 16 has a bearing shoe 17 fastened at the end with a relief pocket 18 therein. Each piston 16 also has a bore 19 which communicates the interior of a cylinder 15 to a relief pocket 18.

Referring to FIGS. 1 and 2, a piston-piloting or guide ring 20 is mounted about the pistons 16 and cylinder block 13 and is of polygonal shape on the inside to present plane surfaces 25 to the bearing shoes 17 of the pistons 16. In addition, an inner support disk 21 and an outer support disk 22 are secured by screws or dowels 27, 28 to the ring 20 on opposite sides of the cylinder block 13 and serve to laterally support the pistons 16. Each of the disks 21, 22 has a pressed-in bearing bushing 23, 24 which rotatably supports the disk on the control journal 12 about an axis of rotation 26 common to the ring 20. The outer support disk 22 also has a flange 29 on the inside for the return stroke of the pistons 16.

A drive shaft 30 is rotatably mounted via roller bearings 31 in the housing cover 11 independently of the piston-piloting ring 20 and carries a drive disk 32 at one end inside the housing 10. An entrainment disk 33 which acts as a coupling between the drive disk 32 and outer support disk 22 is secured to the outer support disk 22 and has four circumferentially disposed recesses. The drive disk 32, in turn, has four extensions 34, only two of which are shown, which mesh in the recesses of the drive disk 32.

As shown in FIG. 1, the control journal 12 has three cylindrical bearing surfaces 35, 36, 37 for respectively supporting the outer support disk 22, the cylinder block 13 and the inner support disk 21. A cylindrical part 38 is also provided for the mounting of the control journal 12 in the housing 10. In addition, two connection lines 39 (of which only one is visible, see FIG. 2) for an operating medium connect to a pair of control slots 40, 41 in the control journal 12 via connection channels 42, 43, 44.

A covering disk 49 is fastened as by bolts to the inner end face of the control journal 12 for axially piloting the support disks 21, 22 and ring 20, Also, a flange 50 is formed on the faces of the cylinder block 13 to axially pilot the block 13 between the support disks 21, 22.

As shown in FIG. 1, the axis of rotation 14 of the cylinder block 13 is eccentric to the axis of rotation 26 of the guide ring 20 and support disks 21, 22 by an amount *e*.

Also, the diameter 45 of the bearing surface 35 for the outer support disk 22 is smaller than the diameter 46 of the bearing surface 30 for the cylinder block 13 by an amount at least equal to twice the eccentricity *e*. Likewise, the diameter 47 of the bearing surface 37 for the inner support disk 21 is greater than the diameter 46 of the bearing surface 36 of the cylinder block 13 by an amount at least equal to twice the eccentricity *e*. Also, the seat diameter 48 of the cylindrical part 38 of the control journal 12 is slightly smaller than the diameter 47 so that the control journal 12 bears against the housing 10.

What is claimed is:

1. A radial piston machine comprising a housing;

a control journal having a cylindrical part of predetermined diameter fixedly mounted in said housing;

a cylinder block rotatably mounted about an axis of rotation on a first cylindrical bearing surface of said control journal;

a plurality of pistons circumferentially disposed in said cylinder block for radial displacement relative to said control journal, each said piston having a bearing shoe thereon;

a piston-piloting ring mounted around said pistons and said cylinder block, said ring having a plurality of plane surfaces thereon, each said surface being disposed opposite to and in bearing relation with a respective piston bearing shoe, said ring having an axis of rotation offset from said axis of rotation of said cylinder block by a preset eccentricity; and a pair of rotatable support disks secured to said piston-piloting ring on opposite sides of said cylinder block, an inner one of said disks being rotatably mounted about a second cylindrical bearing surface of said control journal of a diameter greater than said first bearing surface of said cylinder block by at least twice said eccentricity and an outer one of said support disks being rotatably mounted about a third cylindrical bearing surfce of said control journal, said third cylindrical bearing surface being of a diameter smaller than said first bearing surface of said cylinder block by at least twice said eccentricity.

2. A radial piston machine as set forth in claim 1, wherein said cylindrical part of said control journal is concentric to said axis of rotation of said piston-piloting ring and has a diameter slightly smaller than said diameter of said second cylindrical bearing surface of said control journal.

* * * * *